US005216786A

United States Patent [19]

Anscher

[11] Patent Number: 5,216,786

[45] Date of Patent: Jun. 8, 1993

[54] PLASTIC BUCKLE AND METHOD OF FORMING THEREOF

[75] Inventor: Joseph A. Anscher, Port Washington, N.Y.

[73] Assignee: National Molding Corporation, Farmingdale, N.Y.

[21] Appl. No.: 675,076

[22] Filed: Mar. 25, 1991

[51] Int. Cl.[5] ..... A44B 11/04

[52] U.S. Cl. ..... 24/200

[58] Field of Search ..... 24/198, 200, 197, 169

[56] References Cited

U.S. PATENT DOCUMENTS

| | | | |
|---|---|---|---|
| 807,150 | 12/1905 | Boice . | |
| 1,290,914 | 1/1919 | Comstock, Sr. . | |
| 1,324,629 | 12/1919 | Tabler . | |
| 1,911,441 | 5/1933 | Drews . | |
| 1,999,167 | 4/1935 | White . | |
| 2,302,258 | 11/1942 | Rose et al. | 24/197 |
| 2,316,846 | 4/1943 | Diebold | 24/200 |
| 2,649,637 | 8/1953 | Hodge | 24/200 |
| 2,754,560 | 7/1956 | Warner et al. | 24/196 |
| 3,169,291 | 2/1965 | Stacherl | 24/196 |
| 3,192,588 | 7/1965 | White | 24/200 |
| 3,206,816 | 9/1965 | Vilcins et al. . | |
| 3,336,639 | 8/1967 | Rutty et al. . | |
| 3,349,449 | 10/1967 | Hatfield | 24/197 |
| 3,376,613 | 4/1968 | Lindblad . | |
| 3,407,451 | 10/1968 | Dewey et al. | 24/196 |
| 3,967,347 | 7/1976 | Bickis, Sr. . | |
| 4,117,573 | 10/1978 | Nakamura . | |
| 4,171,555 | 10/1979 | Bakker et al. | 24/200 |
| 4,296,531 | 10/1981 | Bengtsson | 24/200 |
| 4,387,490 | 6/1983 | Blackburn et al. | 24/200 |
| 4,414,713 | 11/1983 | Prete, Jr. | 24/193 |
| 4,484,379 | 11/1984 | Appelt et al. | 24/197 |
| 4,493,135 | 1/1985 | Crook, Jr. | 24/197 |
| 4,677,711 | 7/1987 | Anscher | 24/200 |
| 4,843,689 | 7/1989 | Fildan | 24/200 |
| 4,901,373 | 2/1990 | Broersma | 24/200 X |

FOREIGN PATENT DOCUMENTS 970611 9/1964 United Kingdom .

*Primary Examiner*—James R. Brittain

*Attorney, Agent, or Firm*—Kenyon & Kenyon

[57] ABSTRACT

A plastic fastener comprising a body having two members that define an upper face and a lower face, means for securing the fastener to a workpiece, and means for adjustably securing the strap to the fastener. The adjustably securing means comprises first and second cross-members fixed between and connecting the side members, the first cross-member overlapping the second cross-member to define a strap channel which forms an acute angle with the bottom surface of the second cross-member. A method for molding such a fastener comprises introducing molten plastic into a mold to form a body at an angle to the horizontal having two side members that define an upper face and a lower face, first and second cross-members fixed between and connecting said side members, the first cross-member being horizontally offset from the second cross-member in the mold and the first cross-member overlapping over the second cross-member with respect to the body bottom surface to define a strap channel which forms an acute angle with the underside of the second cross-member, and at least one transverse bar disposed between and connecting the side members.

10 Claims, 3 Drawing Sheets

PLASTIC BUCKLE AND METHOD OF FORMING THEREOF

This invention relates generally to fasteners and methods for making them, and more particularly to buckle-type fasteners adapted to adjustably secure a strap or the like.

BACKGROUND OF THE INVENTION

Adjustable fasteners have many uses in leisure, camping, sports and safety products, where it is desired that a strap or belt be adjustably secured. Examples include seat belts for automobiles, shoulder straps for backpacks or luggage, and the adjustable straps for life jackets. For safety and secureness in operation it is desirable that the buckle retain the adjustable straps in place until the operator purposely releases the strap. Unintentional or accidental release of the adjustable strap can result in premature disengagement of the object secured by the strap.

While a large number of fasteners are well known, reliable and economic fasteners suitable for mass production that provide secure retention of adjustable straps are difficult to make. Among the drawbacks of known fasteners is that the angle of release of a strap held by frictional engagement may be insufficient to prevent accidental release of the strap.

OBJECTS AND SUMMARY OF THE INVENTION

In light of the foregoing, it is an object of the invention to provide a fastener and a method of forming thereof.

It is a further object of the invention to provide a fastener having an improved angle of release for an adjustable strap thereby engaged and to provide a method of forming such a fastener.

It is a further object of the invention to provide a fastener that improves the safety and reliability of articles employing such fasteners and to provide a method of forming such a fastener.

These and other objects of the invention are achieved by providing a fastener having an improved arc angle for release of a strap, preferably greater than about 50°. The fastener has a body having two side members that define an upper face and a lower face, means for securing the fastener to a workpiece, and means for adjustably securing a strap to the fastener, the adjustably securing means comprising first and second cross-members fixed between and connecting the side members, the first cross-member overlapping the second cross-member to define a strap channel which forms an acute angle with the underside of the second cross-member. The arc angle for release of a strap, which is the angle required to pivot the fastener from its normal operating position to achieve release of the strap engaged by the buckle, is therefore improved to greater than about 50°.

The fastener is formed from plastic, preferably by injection molding, in a process that involves engaging a top mold section with a bottom mold section; introducing molten plastic into the mold to form a body at an angle to the horizontal having two side members that define an upper face and a lower face, first and second cross-members fixed between and connecting said side members, the first cross-member being horizontally offset from the second cross-member in the mold and the first cross-member overlapping over the second cross-member with respect to the body bottom surface to define a strap channel which forms an acute angle with the underside of the second cross-member, and at least one transverse bar disposed between and connecting the side members; disengaging at least part of the top mold section from the bottom mold section; and removing the molded plastic from the mold, molding the buckle at an angle from the horizontal.

DETAILED DESCRIPTION OF THE PREFERRED EMBODIMENT

Figure 1:
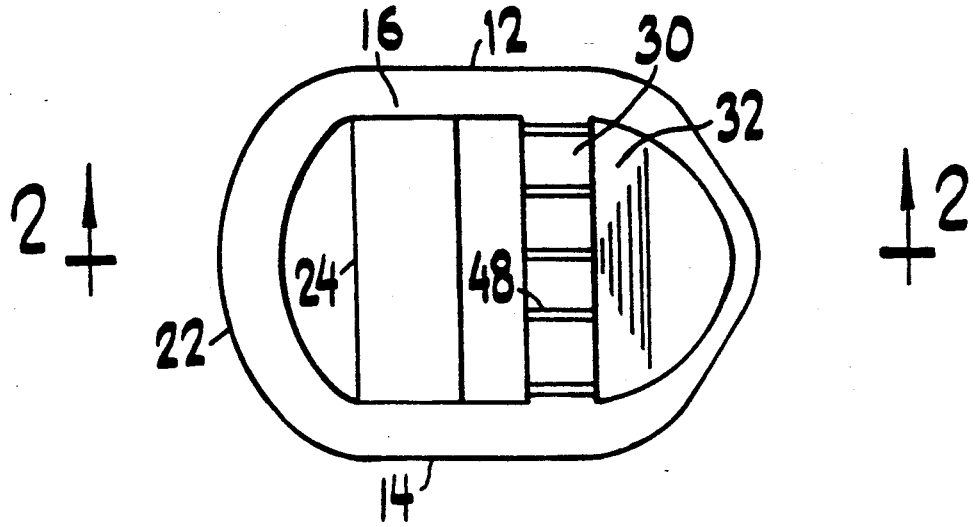
FIG. 1 is a top plan view of a fastener according to the invention.
Figure 2:
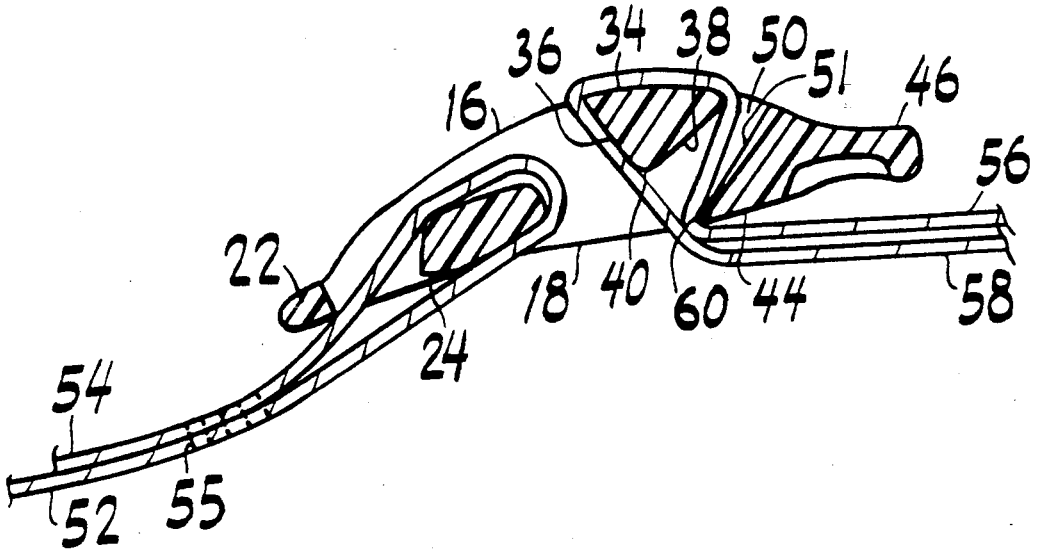
FIG. 2 is a cross-section of the fastener of FIG. 1 along line 2—2, showing a strap fixedly secured to one end of the buckle and a strap adjustably secured to the other end of the fastener.
Figure 3:
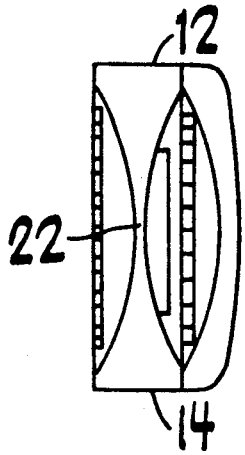
FIG. 3 is a left side view of the fastener of FIG. 1.

Referring to FIG. 1, there is shown a buckle-type fastener, generally identified by reference number 10. Buckle 10 has two side pieces 12 and 14 that define the sides of the buckle 10 and the top and bottom faces 16 and 18, respectively. Side pieces 12 and 14 are symmetrical with respect to each other and preferably are arced as shown in FIG. 2 so that top face 16 and bottom face 18 are not planar. Extending between side pieces 12 and 14 are transverse bars 22 and 24. Preferably, transverse bar 24 is rectangular in cross-section with rounded edges. Preferably, bar 22 is flat in the horizontal plane and arced outwardly away from bar 24 as it extends from side piece 12 to side piece 14, as shown in FIG. 1. Bars 22 and 24 are sized and shaped for fixedly securing a strap to buckle 10. For the purposes of this description, the term strap will be used broadly to denote any strap or web-like material that is suitable to be fastened by a adjustable buckle, including but not limited to woven cloth or synthetic belts, cord and rope.

As can be seen in FIG. 2, also extending between side pieces 12 and 14 are cross-members 30 and 32, sometimes called bars 30 and 32, which comprise the adjustable strap securing means of the buckle 10. Upper bar 30 may be of any desired cross-sectional shape, such as generally triangular, and may have a top surface 34 and two side surfaces 36 and 38, each of which form an acute angle with top surface 34 and meet at a bottom point 40. Top surface 34 may have ribs 48, as is shown in FIG. 1, which serve to ensure that a strap looped over top surface 34 remains flat, and does not bunch or gather.

Transverse bar 32 may have a generally flat bottom surface 44, which may also be ribbed. Transverse bar 32 may be of any desired cross-section, such as generally L-shaped, and may have a surface 51 extending from bottom surface 44 to connect with horizontal handle portion 46.

Buckle 10 is formed so that side surface 38 of upper bar 30 overlaps with surface 51 of cross-member 32. That is, when the buckle 10 is viewed in a cross-section along a horizontal plane, as shown in FIG. 2, at least a portion of the upper bar is located in the same position on the horizontal axis as at least a portion of the lower surface. At the area of overlap, the upper bar is located above the lower surface on the vertical axis and at the same position as the lower surface on the horizontal axis. Preferably, the overlap of the upper bar 30 and cross-member 32 is greater than about 1 mm to about 4 mm. Side surface 38 of upper bar 30 and surface 51 of cross-member 32 are angled with respect to the horizontal and define a strap channel 50 in the area of the overlap of upper bar 30 and cross-member 32. Strap channel 50 and bottom surface 44 form an acute angle $A_2$ due to the overlap of the upper bar and lower surface. Channel 50 is adapted to receive a strap which may be looped around upper bar 30, as shown in FIG. 2.

In operation, one end 52 of a strap 54 is looped around bar 24 and fastened via stitching 55, as shown in FIG. 2. Alternatively, the end 52 of strap 54 is fixedly attached to itself or directly to buckle 10 by other means, for example, glue, staples, or rivets. In certain applications it may be desirable to removably attach end 52 of strap 54 to buckle 10, such as, for example, with a VELCRO® fastener.

The end 56 of a second strap 58 (or a free end of strap 54) can be adjustably secured to the buckle 10 by threading the strap through the buckle, under bar 32, over bar 30, and through strap channel 50. An end portion of the strap 58 overlap and are pinched together to secure the strap 58 at corner 60 of bottom surface 44. The portion of strap 58 contained in channel 50 extends around corner 60 and across surface 44, forming an acute angle with bottom surface 44.

Figure 4:
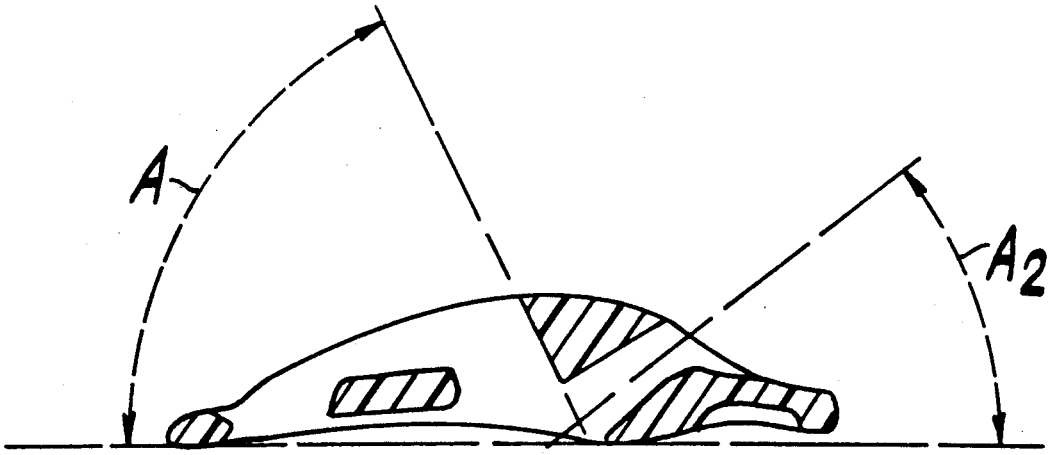
FIG. 4 is a cross-section of the fastener of FIG. 1 along line 2—2 of FIG. 1, showing the arc angle for release of a strap adjustably secured to a fastener of the invention.

The acute angle of the two edges that engage the strap provides a larger arc angle A for release of a strap, preferably greater than about 50°, as shown in FIG. 4. The arc angle A for release of a strap is the angle formed between the horizontal plane 66 of the buckle in its normal position and the plane 68 formed by connection of corner 60 of cross-member 32 and surface 36 of cross-member 30. It has been found that as the angle formed between planes 66 and 68 becomes greater, the buckle must be pivoted to a greater degree to achieve the release angle. The improved arc angle for release thereby better ensures that strap 56 will not be released unintentionally after it is secured by buckle 10. The arc angle A is increased according to the present invention through the overlap of the upper bar 30 over the cross-member 32. Thus, the angular path travelled by strap around corner 60, over the upper bar 30 (including the edges formed by surfaces (34, 38) and (34, 36)), and around corner 60 again grip the strap more securely and require a greater degree of pivot of the buckle to achieve strap release.

Figure 5:
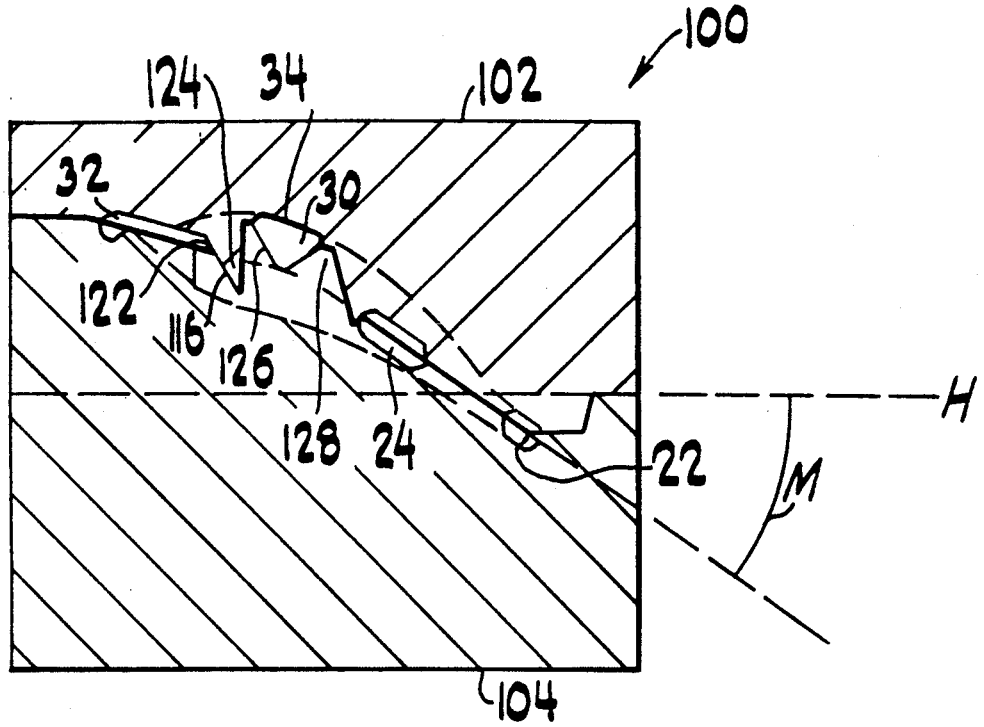
FIG. 5 is a cross-section view of a mold containing plastic, used in the method of the invention.
Figure 1:
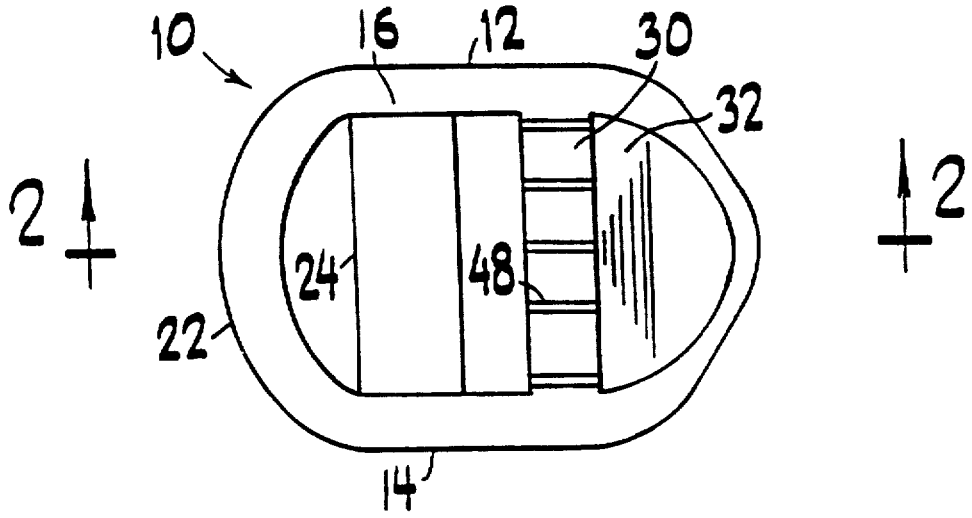
Figure 2:
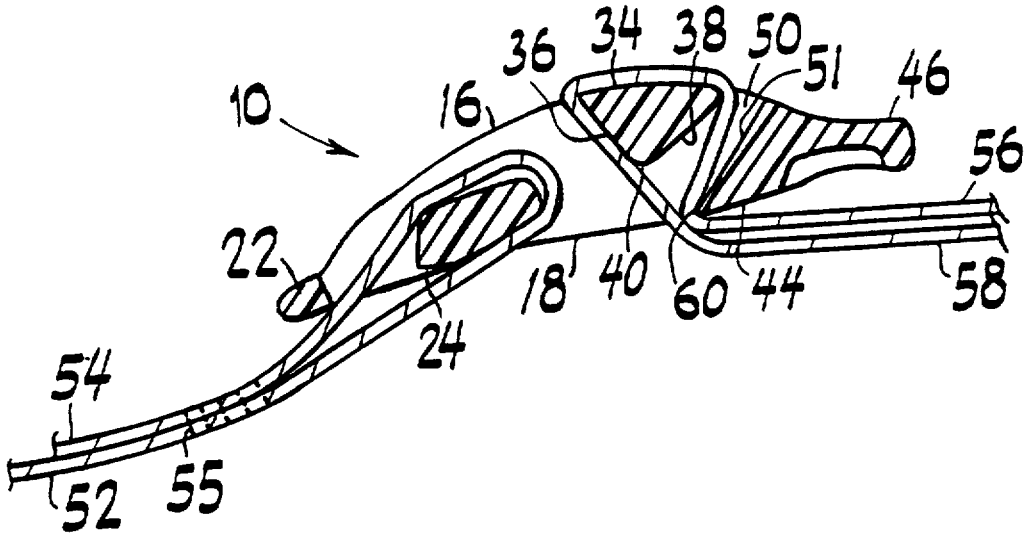
Figure 3:
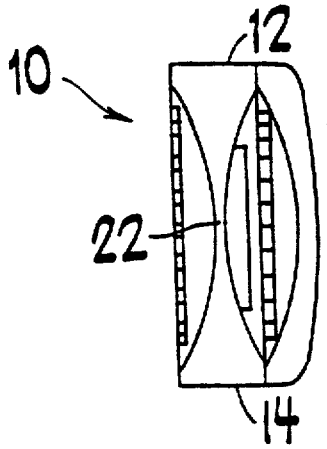
Figure 4:
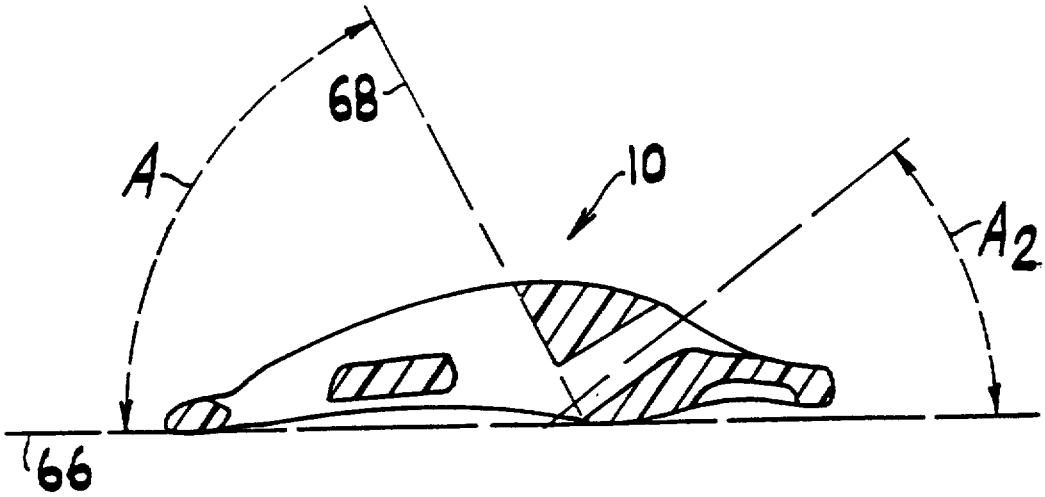
Figure 5:
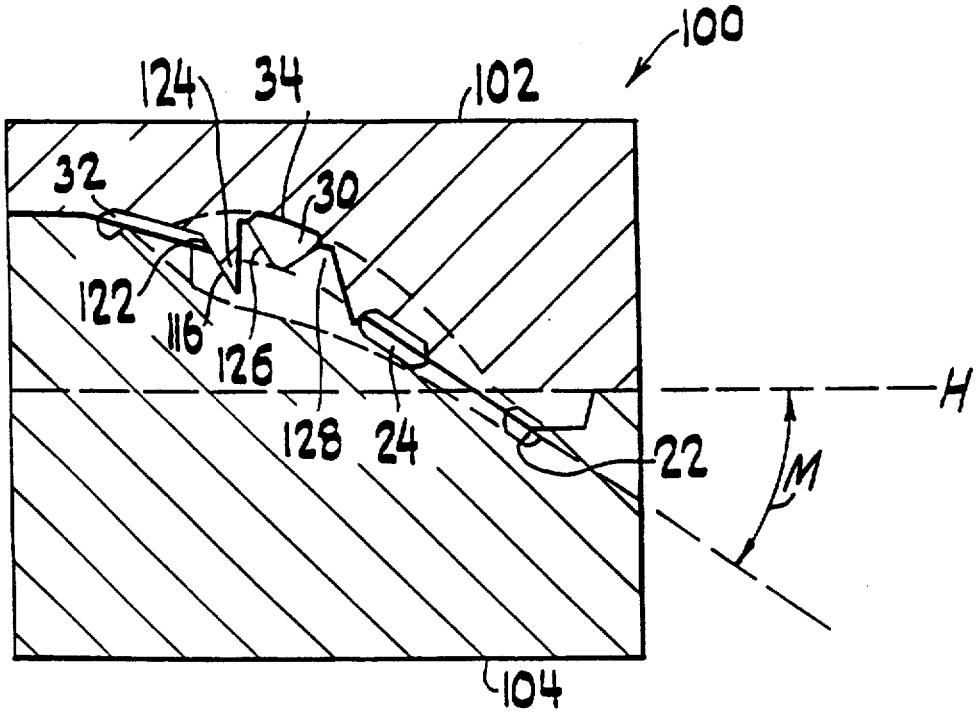

Buckle 10 can be molded from plastic in a mold 100 as shown in FIG. 5. Mold 100 contains a top portion 102 and a bottom portion 104 which define a cavity having a shape complementary to buckle 10. Mold 100 is designed so that side pieces 12 and 14 of buckle 10 will be molded at an angle M from the horizontal plane H.

The mold cavity provides for transverse molded areas which will form cross-member 32, upper bar 34, and transverse bars 22 and 24. The cavity is skewed from horizontal plane H so that channel 50 need not be horizontal. This skewing permits the mold top 102 and the mold bottom to be engaged at angles perpendicular to the horizontal, yet form the overlap between cross-members 30 and 32. The end 122 of the portion of the mold cavity containing cross-member 32 meets mold top section 124 having an angled mold surface 116, whose function is described below. Cross-member 34 is supported by bottom mold sections 126 and 128, which preferably form a generally M-shaped cross-section, as shown in FIG. 5.

Each of the portions of the mold cavity containing members 22, 24, 32, and 34 is at an independent position along plane H in the mold, and does not overlap with any other transverse portion of the mold cavity. That is, each of the portions of the mold cavity containing members 22, 24, 32, and 34 is offset with respect to the other mold cavities between the side pieces along plane H. Thus, a simple mold structure can be utilized in which the top and bottom of the mold can be brought together easily perpendicular to plane H, leaving appropriate mold cavities for forming the buckle.

In operation, mold top 102 contacts mold bottom 104. Mold 100 is then filled with a liquid material, such as molten plastic, which hardens. Suitable plastics for use in the present invention include Derlin and other engineering thermoplastics. The molten plastic enters the cavity and fills the open mold cavities to form side pieces 12 and 14 of buckle 1C and to form mold members 22, 24, 32, and 34. The side pieces are formed at an angle to horizontal plane H. Each of the mold members is offset between the side pieces along plane H and does not overlap any of the other mold members between the side pieces along horizontal plane H in the mold.

Angled surface 116 of mold tool 124 acts against the molten plastic in the mold cavity for mold member 32 to form what will be surface 51 on cross-member 32 of buckle 10. After the plastic has been injected into the mold cavities, the plastic cools until solidified and the mold top can be removed. The buckle is then removed from the mold through the use of ejector pins perpendicularly to the horizontal plane H. The ejector pins can act in a vertical direction from the mold bottom to disengage the molded buckle from the mold. The hardened plastic forms a unitary plastic buckle.

The angle of molding M will define the resulting degree of overlap of the upper bar 30 over the cross-member 32 of the buckle 10. The angle of molding will define the relation of edge 38 of the upper bar 30 to the corner 60 of cross-member 32, and thus the arc angle necessary to achieve release of a strap adjustably secured to the buckle 10. Buckle 10 can be rotated further from the horizontal in the mold 100 than is shown in FIG. 5, with the maximum angle of molding being achieved when surface 38 of upper bar 30 and the transverse bar 24 form a vertical plane in the mold. As a result of the offset of cross-members 30 and 32 in the mold due to the mold angle M and the action of angled surface 116 of top mold portion 124 on the cross-member 32 and bottom mold portions 126 and 128 on upper bar 30, the lower surface is overlapped by the upper bar when the buckle is removed from the mold.

By this process a simple molding procedure can be utilized which yields a product having the necessary overlap of upper bar and lower surface to achieve an increased arc angle for release of a strap. The offset of the upper bar 30 and cross-member 32 portions of the mold cavity in the initial molding step and the angled surface of top mold portion 124 and bottom mold portions 126 and 128 permit use of a relatively simple mold structure, such as that shown in FIG. 5. Additionally, molding the side pieces of the buckle at an angle to the horizontal facilitates the initial offset of the cross-members for ease of molding yet provides the cross-members to be located so that the relative positions of the cross-members are overlapping when the upper bar over the lower surface are removed from the mold.

What is claimed is:

1. A one piece, molded plastic buckle comprising:

(a) a body having two side members that define an upper face and a lower face;

(b) means for securing the buckle to a workpiece; and (c) means for adjustably securing a strap to the buckle, said adjustably securing means comprising first and second cross-members fixed between and connecting said side members, said first cross-member vertically overlapping said second cross-member when the buckle is in a horizontal position and not overlapping said second cross-member when the buckle is rotated around an axis parallel to said cross-members to at least one non-horizontal position so that the buckle may be molded in a two-piece mold.

2. A buckle according to claim 1 wherein the arc angle for release of a strap adjustably secured to said buckle is greater than about 50°.

3. A buckle according to claim 2 wherein the arc angle for release of a strap is about 55°.

4. A buckle according to claim 1 wherein said means for securing the buckle to a workpiece comprises at least one transverse bar disposed between and connecting said side members.

5. A buckle according to claim 1 wherein said first cross-member has a ribbed surface.

6. A buckle according to claim 1 wherein said first cross-member has at least two edges for gripping a strap.

7. A buckle according to claim 1 wherein the underside of said second cross-member is ribbed.

8. A one piece, molded plastic fastener comprising:

(a) body having two side members that define an upper face and a lower face;

(b) means for securing the fastener to a workpiece comprising at least one transverse bar disposed between and connecting said side members; and (c) means for adjustably securing a strap to the fastener, said adjustably securing means comprising first and second cross-members fixed between and connecting said side members, said first cross-member vertically overlapping said second cross-member when the fastener is in a horizontal position to define a strap channel which forms an acute angle with the bottom surface of said fastener, wherein an arc angle for release of a strap adjustably secured to said fastener is greater than about 50°, and wherein said cross-members are not vertically overlapping when the fastener is rotated around an axis parallel to said cross-members to at least one non-horizontal position so that the fastener may be molded in a two-piece mold.

9. A fastener according to claim 8 wherein at least one surface of said first cross-member is ribbed.

10. The fastener of claim 8, wherein said strap channel forms an acute angle with the bottom surface of said second cross-member.

* * * * *

UNITED STATES PATENT AND TRADEMARK OFFICE

CERTIFICATE OF CORRECTION

PATENT NO. : 5,216,786

DATED : June 8, 1993

INVENTOR(S) : Anscher

It is certified that error appears in the above-indentified patent and that said Letters Patent is hereby corrected as shown below:

The title page should be deleted to appear as per attached title page.

The sheets of drawings, consisting of figures 1-5, should be deleted to appear as per attached figs. 1-5.

Signed and Sealed this

Twentieth Day of September, 1994

*Attest:*

Bruce Lehman

BRUCE LEHMAN

*Attesting Officer*

*Commissioner of Patents and Trademarks*

United States Patent [19]

Anscher

[11] Patent Number: 5,216,786

[45] Date of Patent: Jun. 8, 1993

[54] PLASTIC BUCKLE AND METHOD OF FORMING THEREOF

[75] Inventor: Joseph A. Anscher, Port Washington, N.Y.

[73] Assignee: National Molding Corporation, Farmingdale, N.Y.

[21] Appl. No.: 675,076

[22] Filed: Mar. 25, 1991

[51] Int. Cl.[5] ..... A44B 11/04

[52] U.S. Cl. ..... 24/200

[58] Field of Search ..... 24/198, 200, 197, 169

[56] References Cited

U.S. PATENT DOCUMENTS

| | | | |
|---|---|---|---|
| 807,150 | 12/1905 | Boice . | |
| 1,290,914 | 1/1919 | Comstock, Sr. . | |
| 1,324,629 | 12/1919 | Tabler . | |
| 1,911,441 | 5/1933 | Drews . | |
| 1,999,167 | 4/1935 | White . | |
| 2,302,258 | 11/1942 | Rose et al. | 24/197 |
| 2,316,846 | 4/1943 | Diebold | 24/200 |
| 2,649,637 | 8/1953 | Hodge | 24/200 |
| 2,754,560 | 7/1956 | Warner et al. | 24/196 |
| 3,169,291 | 2/1965 | Stacherl | 24/196 |
| 3,192,588 | 7/1965 | White | 24/200 |
| 3,206,816 | 9/1965 | Vilcins et al. . | |
| 3,336,639 | 8/1967 | Rutty et al. . | |
| 3,349,449 | 10/1967 | Hatfield | 24/197 |
| 3,376,613 | 4/1968 | Lindblad . | |
| 3,407,451 | 10/1968 | Dewey et al. | 24/196 |
| 3,967,347 | 7/1976 | Bickis, Sr. . | |
| 4,117,573 | 10/1978 | Nakamura . | |
| 4,171,555 | 10/1979 | Bakker et al. | 24/200 |
| 4,296,531 | 10/1981 | Bengtsson | 24/200 |
| 4,387,490 | 6/1983 | Blackburn et al. | 24/200 |
| 4,414,713 | 11/1983 | Prete, Jr. | 24/193 |
| 4,484,379 | 11/1984 | Appelt et al. | 24/197 |
| 4,493,135 | 1/1985 | Crook, Jr. | 24/197 |
| 4,677,711 | 7/1987 | Anscher | 24/200 |
| 4,843,689 | 7/1989 | Fildan | 24/200 |
| 4,901,373 | 2/1990 | Broersma | 24/200 X |

FOREIGN PATENT DOCUMENTS 970611 9/1964 United Kingdom .

*Primary Examiner*—James R. Brittain

*Attorney, Agent, or Firm*—Kenyon & Kenyon

[57] ABSTRACT

A plastic fastener comprising a body having two members that define an upper face and a lower face, means for securing the fastener to a workpiece, and means for adjustably securing the strap to the fastener. The adjustably securing means comprises first and second cross-members fixed between and connecting the side members, the first cross-member overlapping the second cross-member to define a strap channel which forms an acute angle with the bottom surface of the second cross-member. A method for molding such a fastener comprises introducing molten plastic into a mold to form a body at an angle to the horizontal having two side members that define an upper face and a lower face, first and second cross-members fixed between and connecting said side members, the first cross-member being horizontally offset from the second cross-member in the mold and the first cross-member overlapping over the second cross-member with respect to the body bottom surface to define a strap channel which forms an acute angle with the underside of the second cross-member, and at least one transverse bar disposed between and connecting the side members.

10 Claims, 3 Drawing Sheets

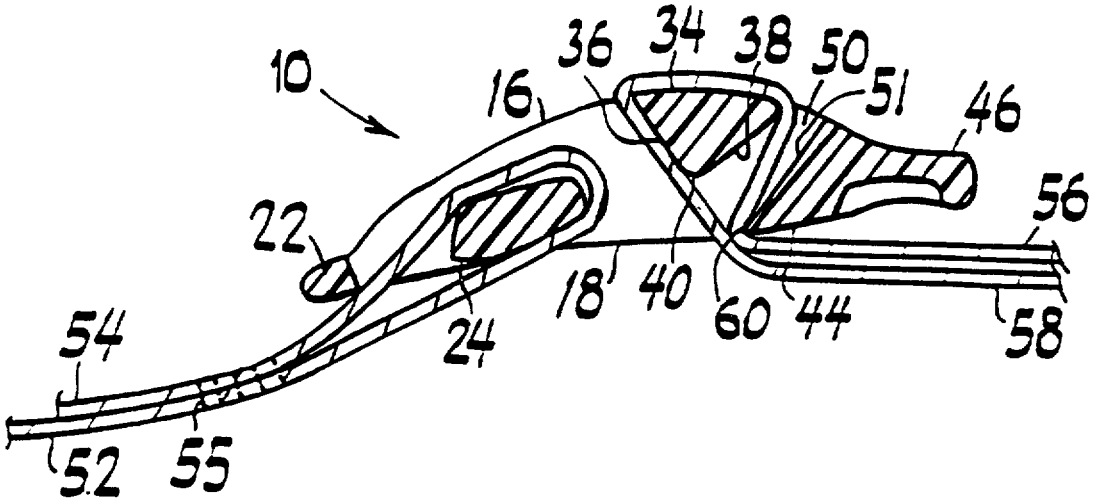

UNITED STATES PATENT AND TRADEMARK OFFICE

CERTIFICATE OF CORRECTION

PATENT NO. : 5,216,786

DATED : June 8, 1993

INVENTOR(S) : Joseph A. Anscher

It is certified that error appears in the above-indentified patent and that said Letters Patent is hereby corrected as shown below:

Column 2, line 44, change "a" to --an--.

Column 3, line 27, change "overlap and are" to --is overlapped and--.

Column 3, line 43, change "56" to --58--.

Column 5, line 21, change "the" to --an--.

Column 6, line 7, before "body" insert --a--.